US006558198B2

(12) United States Patent
Kobayashi et al.

(10) Patent No.: US 6,558,198 B2
(45) Date of Patent: May 6, 2003

(54) FUSE DEVICE AND FUSE DEVICE CONNECTING STRUCTURE

(75) Inventors: Takehito Kobayashi, Nagoya (JP); Takahiro Onizuka, Nagoya (JP); Isao Isshiki, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/991,995

(22) Filed: Nov. 26, 2001

(65) Prior Publication Data

US 2002/0064999 A1 May 30, 2002

(30) Foreign Application Priority Data

Nov. 30, 2000 (JP) ..... 2000-364604
Dec. 6, 2000 (JP) ..... 2000-371771

(51) Int. Cl.[7] ..... H01R 33/95

(52) U.S. Cl. ..... 439/622; 439/251; 439/830; 337/290; 337/295

(58) Field of Search ..... 439/622, 830, 439/249, 250, 251, 787, 723; 337/295, 290, 256

(56) References Cited

U.S. PATENT DOCUMENTS 4,563,666 A * 1/1986 Borzoni ..... 333/252
4,661,793 A * 4/1987 Borzoni ..... 337/260
4,878,862 A * 11/1989 Wise ..... 439/787
5,088,940 A * 2/1992 Saito ..... 439/621
5,346,411 A * 9/1994 Nikkinen ..... 439/621
5,507,669 A * 4/1996 Jannett et al. ..... 439/621
5,748,067 A * 5/1998 Ishii et al. ..... 337/160
5,841,338 A * 11/1998 Yasukuni ..... 337/293
5,886,611 A * 3/1999 Schaller et al. ..... 337/189
5,977,859 A * 11/1999 Kawamura et al. ..... 337/295

FOREIGN PATENT DOCUMENTS

| | | |
|---|---|---|
| JP | A 59-23430 | 2/1984 |
| JP | A 61-142623 | 6/1986 |
| JP | A 1-241729 | 9/1989 |
| JP | A 2000-182506 | 6/2000 |

* cited by examiner

*Primary Examiner*—P. Austin Bradley
*Assistant Examiner*—Briggitte R. Hammond
(74) *Attorney, Agent, or Firm*—Oliff & Berridge, PLC

(57) ABSTRACT

A fuse device is provided with a plurality of separate fuse main bodies in which fuse terminals and fuse terminals are formed at the opposite ends of fusing elements, and a plurality of connection terminals which are members separate from the fuse main bodies. A fuse circuit in which the fusing elements are provided between the connection terminals is formed by directly connecting the fuse terminals of the respective fuse main bodies with the connection terminals. The fusing characteristics of the fusing elements and the strength of the connection terminals can be adjusted without influencing each other.

13 Claims, 13 Drawing Sheets

30A(t=0.3mm)

20A(t=0.2mm)

15A(t=0.2mm)

10A(t=0.15mm)

7.5A(t=0.15mm)

FUSE DEVICE AND FUSE DEVICE CONNECTING STRUCTURE

BACKGROUND OF THE INVENTION

This invention relates to a fuse device mounted in an electrical connection box used, for example, in a vehicle to prevent an overcurrent from flowing into electrical circuits built in the electrical connection box.

Known conventional fuse devices of the aforementioned type are shown in FIGS. 13 and 14. The fuse device of FIG. 13 is constructed such that a fusing element 300 has connection terminals 301 thicker than the fusing element 300 connected at the opposite ends thereof and the fusing element 300 and the connection terminals 301 are covered by an insulating resin member 302 except leading end portions of the connection terminals 301. The fusing element 300 and the connection terminals 301 are formed by stamping out a single metallic plate having a portion corresponding to the fusing element 300 adjusted to a smaller thickness. This fuse device is mounted in an electrical connection box by connecting the connection terminals 301 thereof with unillustrated busbars provided in the electrical connection box.

On the other hand, a fuse device of FIG. 14 is constructed such that each of two fusing elements 310 has a common connection terminal (input terminal) 311 thicker than the fusing element 310 connected at one end thereof and has two separate connection terminals (output terminals) 312 having the same thickness as the connection terminal 311 connected at the other end thereof, and the respective fusing elements 310 and connection terminals 311, 312 are covered by an insulating resin member 313 except leading end portions of the connection terminals 311, 312. The fuse device includes a pair of pieces each including two fusing elements 310, one connection terminal 311 and two connection terminals 312. The fusing element 310 and the connection terminals 311, 312 are formed by stamping out a single metallic plate having portions corresponding to the fusing elements 310 adjusted to a smaller thickness. Similar to the above fuse device of FIG. 13, this fuse device is mounted in an electrical connection box by connecting the connection terminals 311, 312 thereof with unillustrated busbars provided in the electrical connection box.

Since the unitary piece of the fusing element(s) and the connection terminals forming the conventional fuse devices is formed by stamping out the single metallic plate as described above, there is a limit in adjusting the fusing characteristic of the fusing element and the strength of the connection terminals without influencing each other.

SUMMARY OF THE INVENTION

It is an object of the present invention to provide a fuse device and fuse connecting structure which are free from the problems residing in the prior art.

According to an aspect of the invention, a fuse device is provided with connection terminals; and a fuse main body including fuse terminals and a fusing element whose opposite ends are connected with the fuse terminals. The fuse terminals are directly connected with the respective connection terminals to form a fuse circuit in which the fusing element is between the connection terminals.

The device makes it possible to adjust the fusing characteristic of the fusing element and the strength of connection terminals without influencing each other.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
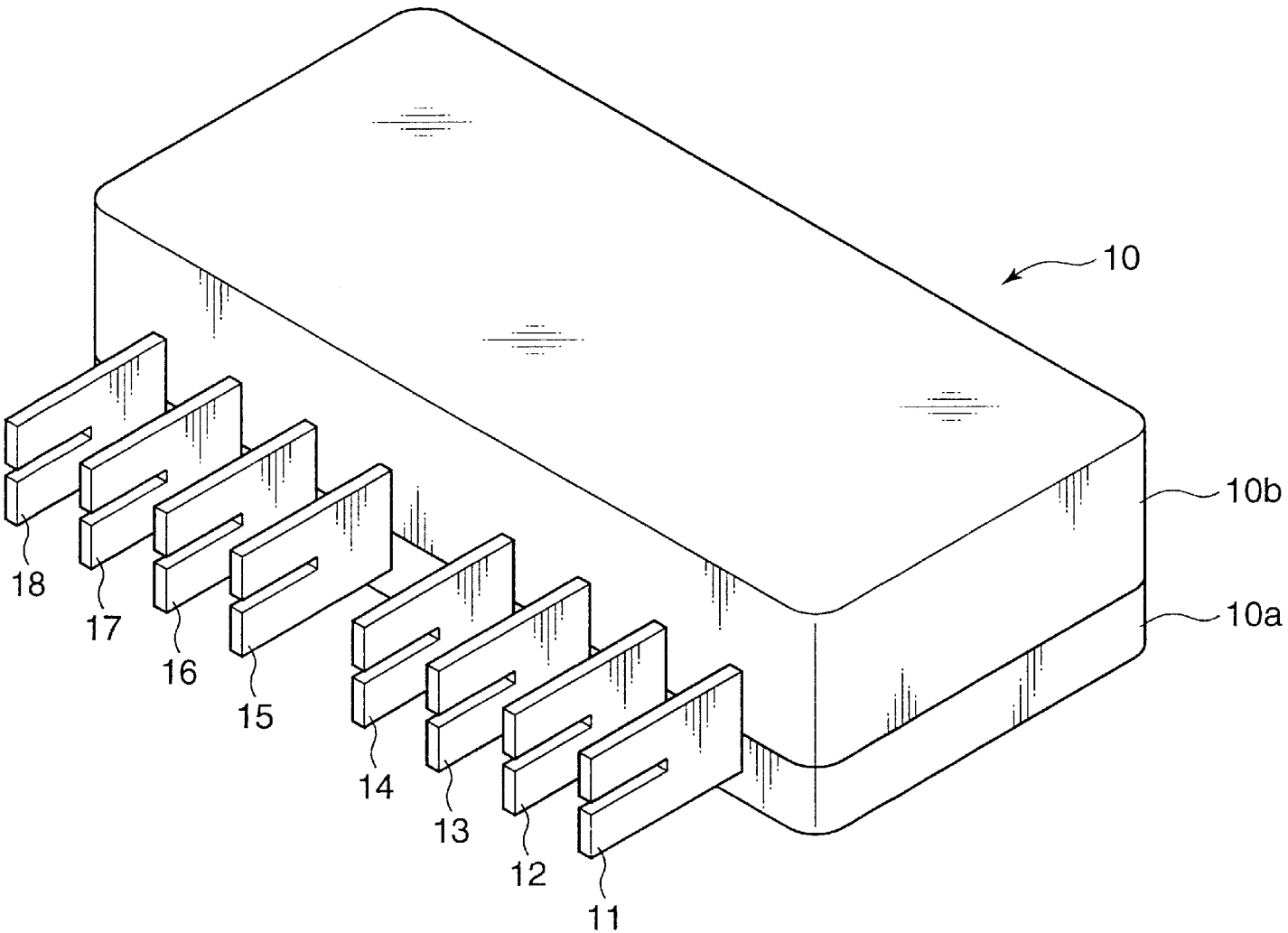
FIG. 1 is a perspective view showing an external configuration of a fuse device according to a first embodiment of the invention.

A preferred embodiment of the invention is specifically described. As shown in FIG. 1, a fuse device includes a fuse casing 10 which is comprised of a fuse casing main body 10*a* and a cover 10*b*.

Figure 2:
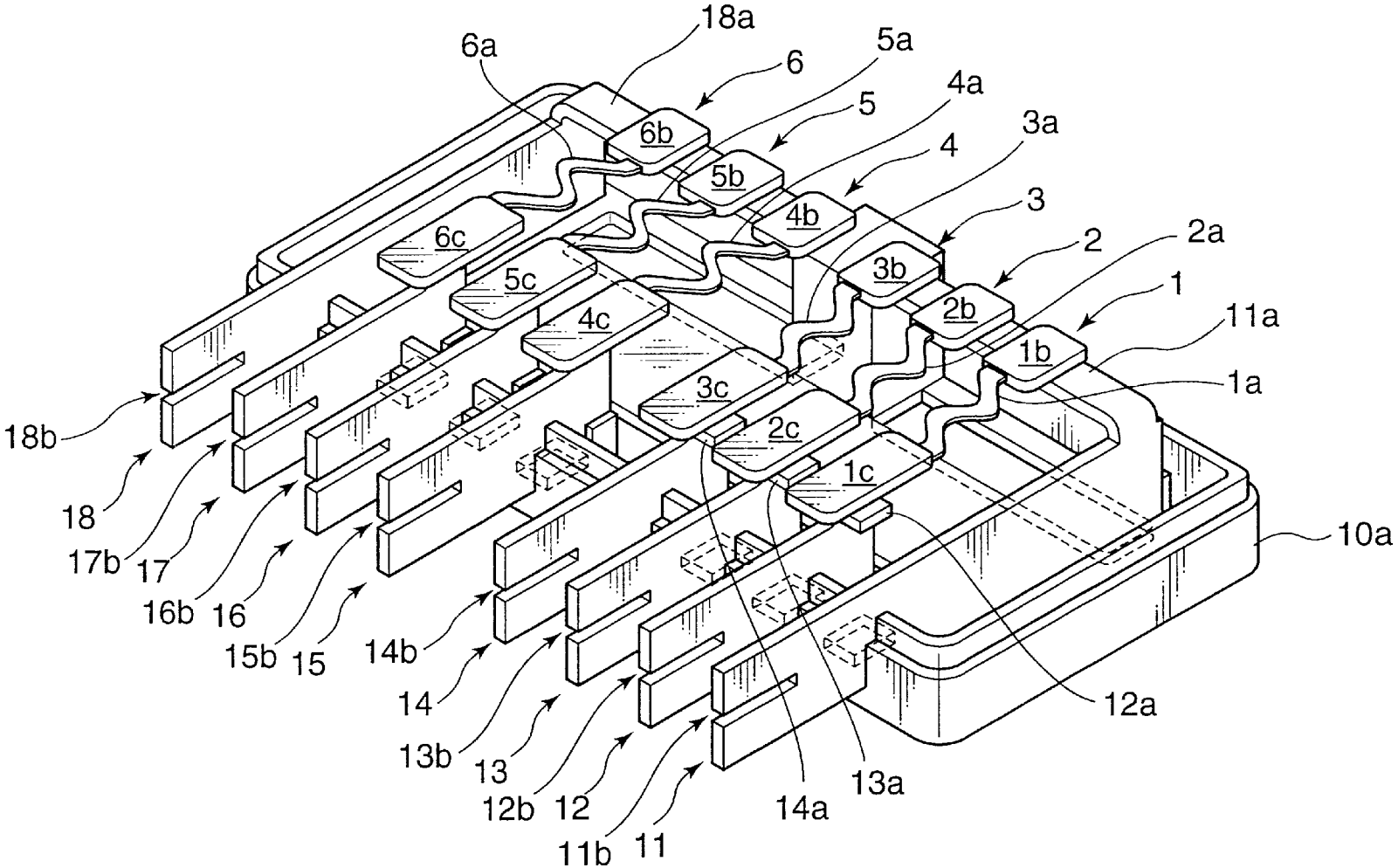
FIG. 2 is a perspective view showing an interior of the fuse device.

As shown in FIG. 2 (the cover 10*b* is not shown), a plurality of (six in the shown example) fuse main bodies 1, 2, 3, 4, 5, 6, the same number of input connection terminals 12, 13, 14, 15, 16, 17 as the fuse main bodies, and two output connection terminals 11, 18 are accommodated in the fuse casing 10 except portions thereof.

Each fuse main body 1 to 6 is a plate member made of a low-melting metal such as Zn in which a fuse terminal 1*b* to 6*b* is provided at one end of a fusing element 1*a* to 6*a* and a fuse terminal 1*c* to 6*c* is provided at the other end thereof.

These fuse main bodies 1 to 6 can be mass-produced by stamping out a metallic plate having portions corresponding to the fusing elements 1*a* to 6*a* thinned by, for example, carving in advance. In the fuse main bodies 1 to 6 thus formed, the fuse terminals 1*b* to 6*b* and the fuse terminals 1*c* to 6*c* have the same thickness and are thicker than the fusing elements 1*a* to 6*a*. Specific examples of dimensions of the fuse main bodies 1 to 6 are described later.

Figure 3:
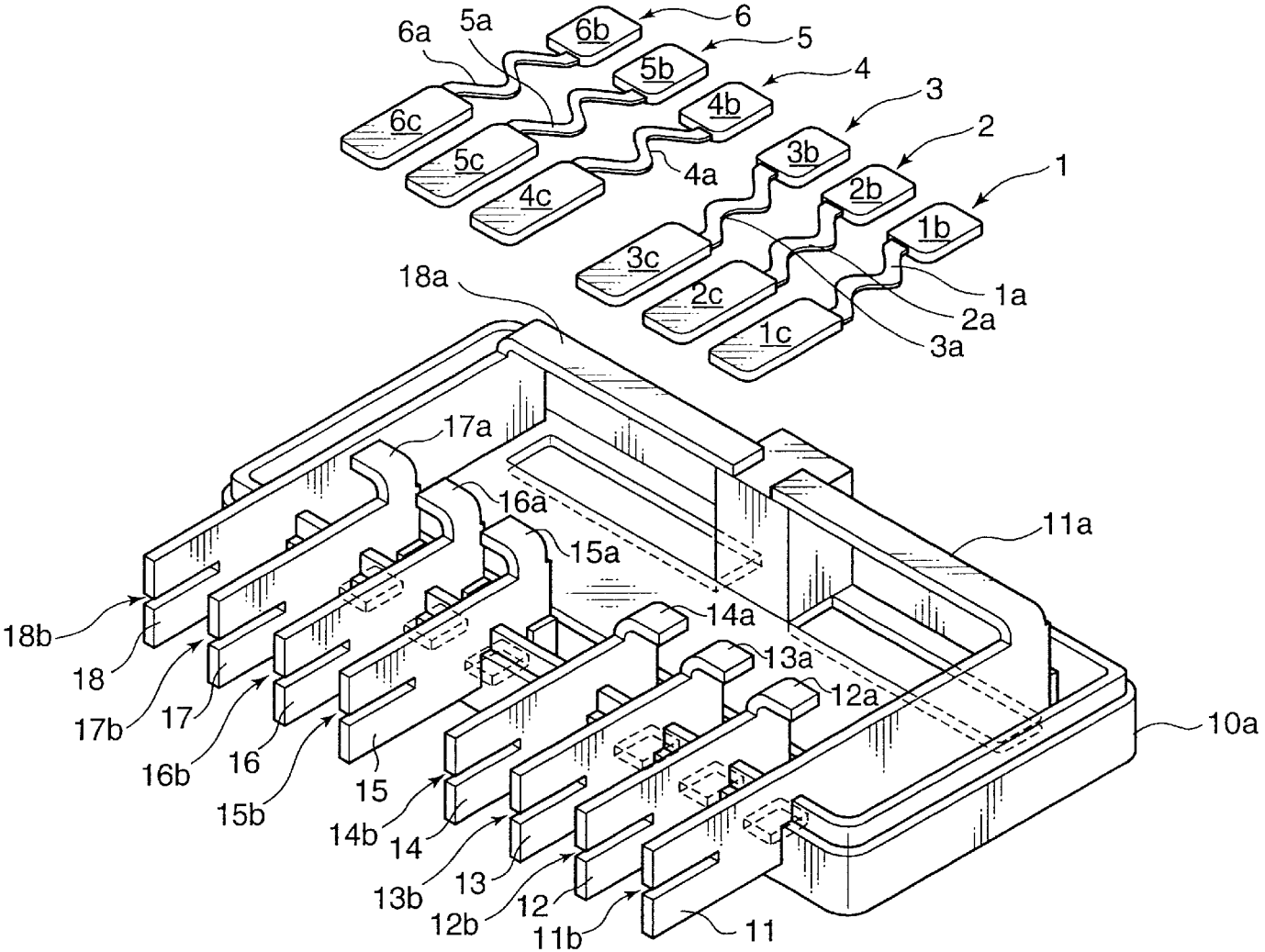
FIG. 3 is an exploded perspective view of the fuse device.

The input connection terminals 12 to 17 are shorter than the output connection terminals 11, 18. Connecting portions 12*a* to 17*a* are provided at the ends of the input connection terminals 12 to 17 located at the inner side of the fuse casing main body 10*a* by, for example, being bent at right angles, whereas forked inserting portions 12*b* to 17*b* each having a specified slit are formed at the ends of the input connection terminals 12 to 17 at the outer side of the fuse casing main body 10*a*. The connecting portions 12*a* to 14*a* and the connecting portions 15*a* to 17*a* are bent in opposite directions as clearly shown in FIG. 3.

Further, connecting portions 11*a*, 18*a* are provided at the ends of the longer output connection terminals 11, 18 located at the inner side of the fuse casing main body 10*a* by, for example, being bent at right angles, whereas forked inserting portions 11*b*, 18*b* each having a specified slit are formed at the ends of the output connection terminals 1, 18 at the outer side of the fuse casing main body 10*a*. The connecting portions 11*a*, 18*a* are bent in opposite directions as clearly shown in FIG. 3 and have such a length that their projecting ends reach a substantially middle position of the fuse casing main body 10*a* with respect to longitudinal direction.

These connection terminals 11 to 18 are set at specified positions inside the fuse casing main body 10*a*, and the fuse terminals 1*b* to 6*b*, 1*c* to 6*c* of the fuse main bodies 1 to 6 are placed on the connecting portions 11*a* to 18*a* of the set connection terminals 11 to 18 and electrically connected therewith, for example, by welding.

More specifically, the fuse terminals 1*c*, 1*b* of the fuse main body 1 are respectively placed on the connecting portion 12*a* and the connecting portion 11*a*; the fuse terminals 2*c*, 2*b* of the fuse main body 2 are respectively placed on the connecting portion 13*a* and the connecting portion 11*a*; and the fuse terminals 3*c*, 3*b* of the fuse main body 3 are respectively placed on the connecting portion 13*a* and the connecting portion 11*a*. The respective fuse terminals and the respective connecting portions are connected, for example, by welding. In other words, the connecting portion 11*a* is commonly used by three fuse main bodies 1 to 3.

Further, the fuse terminals 4*c*, 4*b* of the fuse main body 4 are respectively placed on the connecting portion 15*a* and the connecting portion 18*a*; the fuse terminals 5*c*, 5*b* of the fuse main body 5 are respectively placed on the connecting portion 16*a* and the connecting portion 18*a*; and the fuse terminals 6*c*, 6*b* of the fuse main body 6 are respectively placed on the connecting portion 17*a* and the connecting portion 18*a*. The respective fuse terminals and the respective connecting portions are connected, for example, by welding. In other words, the connecting portion 18*a* is commonly used by three fuse main bodies 4 to 6.

The fuse device of this embodiment is completed by putting the cover 10*b* on the fuse casing main body 10*a* in which the fuse main bodies 1 to 6 and the connection terminals 11 to 18 are mounted in this manner. It should be noted that the ends of the connection terminals 11 to 18 where the forked inserting portions 11*b* to 18*b* are formed project out through a plurality of slits 10*c* formed in the fuse casing 10 and are arrayed while being opposed to each other.

Figure 4:
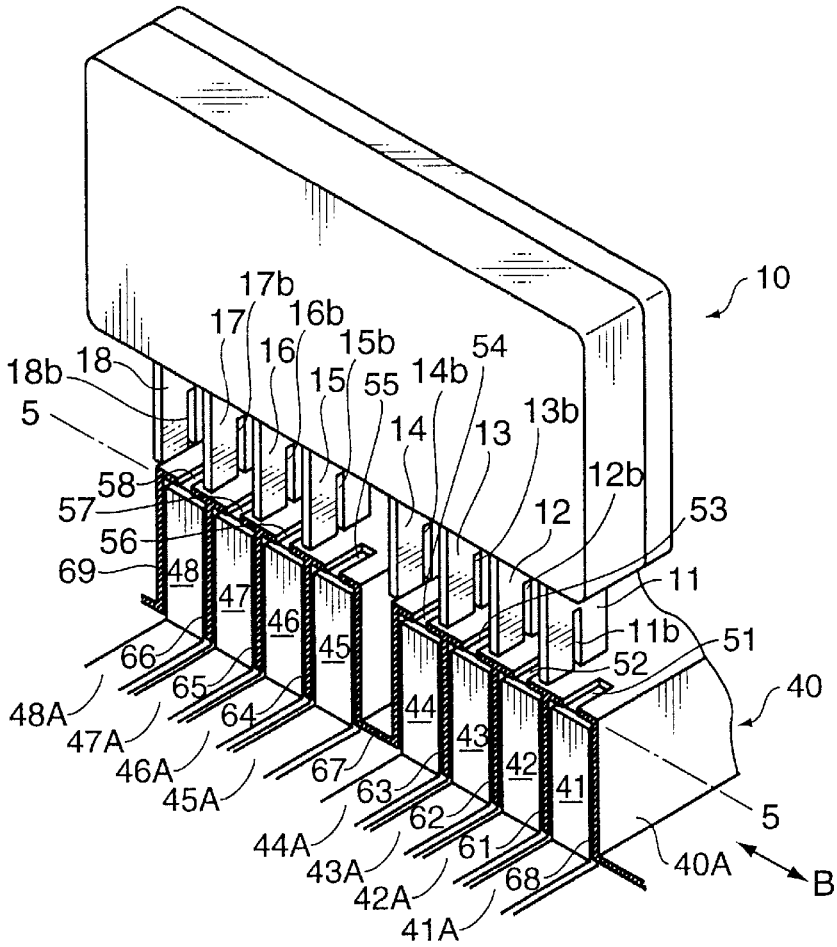
FIG. 4 is a perspective view showing how the fuse device is connected with tab terminals.

FIG. 4 is a perspective view in section showing the construction of a mating electrical connection box 40 with which this fuse device is to be connected. In FIG. 4, a casing portion 40*a* of the electrical connection box 40 is shown in section along the line 5—5.

A busbar board (not shown) including busbars 41A to 48A having tab terminals 41 to 48 at their ends is accommodated in this electrical connection box 40, and the upper ends of the tab terminals 41 to 48 reach up to the vicinity of the inner surface of the outermost casing portion 40A of the electrical connection box 40. The thickness of the tab terminals 41 to 48 is substantially equal to the width of the slits of the forked inserting portions 11*b* to 18*b*.

The outermost casing portion 40A is made of, e.g., an insulating resin, and slit-shaped insertion holes 51 to 58 into which the connection terminals 11 to 18 of the fuse device are insertable are so formed in a portion of the casing portion 40A covering the tab terminals 41 to 48 as to extend in a direction normal to widthwise directions B of the tab terminals 41 to 48. At the longitudinal center positions of the respective insertion holes 51 to 58, the centers of the respective tab terminals 41 to 48 with respect to widthwise directions B are exposed.

The length of the insertion holes 51 to 58 are substantially equal to the width of the connection terminals 11 to 18, whereas the width thereof is substantially equal to the thickness of the connection terminals 11 to 18. Suspended pieces 61 to 63 which are integral parts of the outermost casing portion 40A are provided between four adjacent tab terminals 41 to 44, whereas suspended pieces 64 to 66 which are integral parts of the outermost casing portion 40A are provided between four adjacent tab terminals 45 to 48. Further, bent portions 67, 68, 69 of the outermost casing portion 40A are provided between the tab terminals 44 and 45 and at the outer sides of the tab terminals 41 and 48, respectively.

Figure 5:
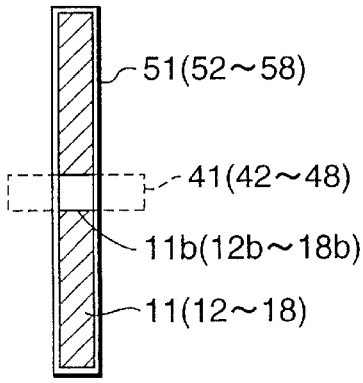
FIG. 5 is a plan view in section showing a state where connection terminals of the fuse device are connected with the tab terminals of an electrical connection box.

The fuse device is connected with the electrical connection box 40 thus constructed as follows. By inserting the connection terminals 11 to 18 of the fuse device into the insertion holes 51 to 58, the connection terminals 11 to 18 are guided by the insertion holes 51 to 58 so that the tab terminals 41 to 48 are inserted into the forked inserting portions 11*b* to 18*b* of the connection terminals 11 to 18 as shown in FIG. 5, thereby electrically connecting the connection terminals 11 to 18 and the tab terminals 41 to 48.

Figure 6A:
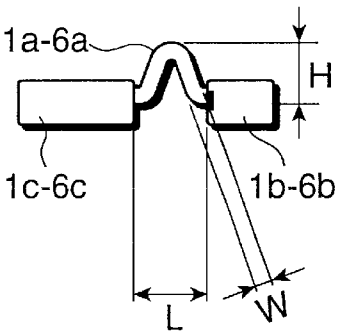
FIGS. 6A to 6E are diagrams showing modes of a plurality of fuse main bodies forming the fuse device.
Figure 6B:
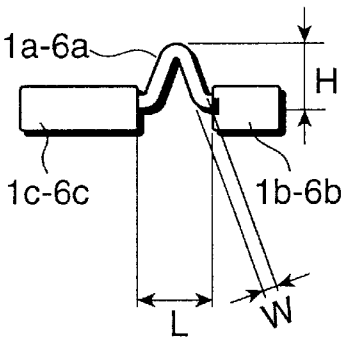
Figure 6C:
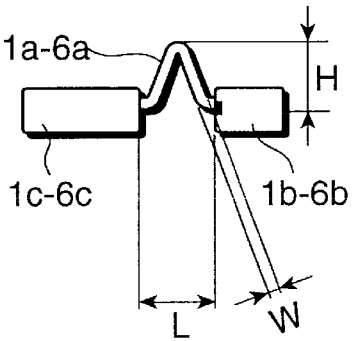
Figure 6D:
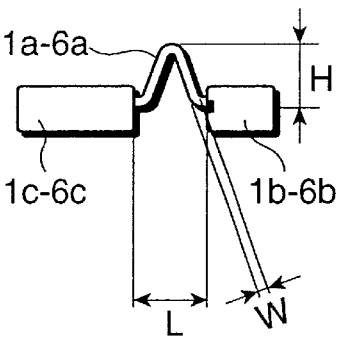
Figure 6E:
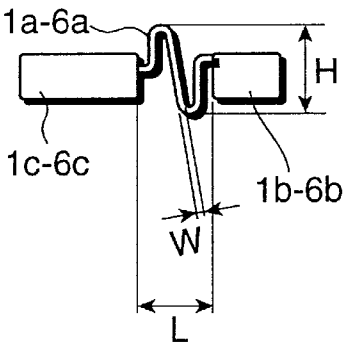

FIGS. 6A to 6E are diagrams showing examples of the aforementioned fuse main bodies 1 to 6, wherein FIG. 6A shows a fuse main body having a fuse capacity of 30A, FIG. 6B shows a fuse main body having a fuse capacity of 20A, FIG. 6C shows a fuse main body having a fuse capacity of 15A, FIG. 6D shows a fuse main body having a fuse capacity of 1A and FIG. 6E shows a fuse main body having a fuse capacity of 7.5 A.

These five kinds of fuse main bodies are fabricated by stamping a metallic plate out, respectively. Upon this fabrication, thickness (t), height (H) and width (W) (i.e., shape) of a portion of the metallic plate before stamping corresponding to the fusing element 1*a* to 6*a* are adjusted to adjust the fuse capacity of the fusing element. The shape of the fusing element 1*a* to 6*a* is pointed at one side in FIGS. 6A to 6D while being sinuous in FIG. 6E. Further, spacing L between the fuse terminals 1*b* to 6*b* and 1*c* to 6*c* at the opposite sides is constantly set at 5.4 mm and the shape and size of the fuse terminals 1*b* and 1*c* are same in order to enable each fuse main body to be used as a substitute for another.

Specifically, the thickness t of the fusing element 1*a* to 6*a* of the fuse main body having a fuse capacity of 30A shown in FIG. 6A is 0.3 mm; the thickness t of the fusing element 1*a* to 6*a* of the fuse main body having a fuse capacity of 20A shown in FIG. 6B is 0.2 mm, which is thinner than the thickness t of the fusing element shown in FIG. 6A; the thickness t of the fusing element 1*a* to 6*a* of the fuse main body having a fuse capacity of 15A shown in FIG. 6C is 0.2 mm which is same as the thickness t of the fusing element shown in FIG. 6B; the thickness t of the fusing element 1*a* to 6*a* of the fuse main body having a fuse capacity of 10A shown in FIG. 6D is 0.15 mm, which is thinner than the thickness t of the fusing elements shown in FIG. 6B and 10C; and the thickness t of the fusing element 1*a* to 6*a* of the fuse main body having a fuse capacity of 7.5 A shown in FIG. 6E is 0.15 mm. The shape, height H, and width W of the fusing element 1*a* to 6*a* are suitably set according to the fuse capacity. The shape and the dimensions of the fusing elements 1*a* to 6*a* of these five kinds of fuse main bodies are merely examples, and fuse main bodies having fuse capacities different from those of the above five kinds of fuse main bodies may be fabricated.

In this embodiment, for example, the fuse main bodies having a fuse capacity of 30 A are arranged like mirror images as the fuse main bodies 1, 6; the fuse main bodies having a fuse capacity of 20 A are arranged like mirror images as the fuse main bodies 2, 5, and the fuse main bodies having a fuse capacity of 10 A are arranged like mirror images as the fuse main bodies 3, 4. Since the respective fuse main bodies of this embodiment have a constant spacing L between the fuse terminals 1*b* to 6*b* and 1*c* to 6*c*, desired ones of the fuse main bodies shown in FIGS. 6A to 6E can be used.

As described above, the respective fuse main bodies 1 to 6 to be directly connected with the connection terminals 11 to 18 are members separate from the connection terminals 11 to 18 in the first embodiment. Thus, the fusing characteristics of the fusing elements 1*a* to 6*a* and the strength of the connection terminals 11 to 18 can be adjusted without influencing each other. Further, the respective fuse main bodies 1 to 6 are separate members having the fuse terminals 1*b* to 6*b*, 1*c* to 6*c* at the opposite ends of the fusing elements 1*a* to 6*a*. Thus, a fuse circuit including a plurality of kinds of fusing elements 1*a* to 6*a* having different fusing characteristics can be constructed as a single unit by preparing a plurality of kinds of fuse main bodies 1 to 6 having the fusing elements 1*a* to 6*a* of different thicknesses in large quantities using different metallic plates for the respective thicknesses and using a single metallic plate for the same thickness, and selecting the fusing elements 1*a* to 6*a* from a plurality of kinds of fuse main bodies thus prepared and connecting them with the connection terminals 11 to 18. Further, since the fuse main bodies 1 to 6 having the fusing elements 1*a* to 6*a* of the same thickness can be mass-produced by, for example, stamping out a single metallic plate as described above and suitable ones may be selected from the mass-produced fuse main bodies and combined, productivity will not be degraded. Furthermore, since the single unit includes a plurality of fuse main bodies 1 to 6, the number of the fuse devices to be mounted on the busbar board can be reduced without complicating the construction of the busbar board.

In the first embodiment, the thicknesses of the fusing elements 1*a* to 3*a* of the three fuse main bodies 1 to 3 differ from each other, and the thicknesses of the fusing elements 4*a* to 6*a* of the three fuse main bodies 4 to 6 differ from each other. Thus, a fuse circuit including six fusing elements having different fusing characteristics can be realized as a single unit. Further, since the spacing L between the fuse terminals 1*b* to 6*b* and 1*c* to 6*c* at the opposite sides of a plurality of fuse main bodies, for example, shown as examples in FIGS. 6A to 6E is the same, the fuse main bodies having different fusing characteristics can be replaced by each other and the connection terminals 11 to 18 can be used common to these fuse main bodies.

Further, since the connection terminals 11 to 18 and the fuse main bodies 1 to 6 are separate members, materials suited to the purposes can be used for the fusing elements 1*a* to 6*a* aimed to be fused and the connection terminals 11 to 18 aimed to be connected with the tab terminals 41 to 48. Specifically, the connection terminals 11 to 18 and the tab terminals 41 to 48 can be held satisfactorily connected over a long time by using a material such as Zn having a desired fusing characteristic for the fuse main bodies 1 to 6 while using a material such as Cu having a high strength for the connection terminals 11 to 18. Further, in the case that the connection terminals 11 to 18 and the fuse main bodies 1 to 6 are separate members, they can be connected, for example, by welding. This makes the connection terminals 11 to 18 and the fuse main bodies 1 to 6 firmly integral to each other, thereby making the fuse device easier to handle and bettering a connectability with the tab terminals 41 to 48.

Further, in the first embodiment, the connection terminals 11 to 18 of the fuse device are electrically connected with the tab terminals 41 to 48 by inserting the tab terminals 41 to 48 into the forked inserting portions 11*b* to 18*b* formed at the connection terminals 11 to 18. Thus, the fuse device can be directly connected with the tab terminals 41 to 48 without using the intermediate terminals 321 as described above. Furthermore, since the width of the slits of the forked inserting portions 11*b* to 18*b* is substantially equal to the thickness of the tab terminals 41 to 48 to be inserted into these slits of the forked inserting portions 11*b* to 18*b*, the connection terminals 11 to 18 and the tab terminals 41 to 48 can be securely connected with each other. Further, if the connection terminals 11 to 18 of the fuse device are inserted into the insertion holes 51 to 58, the tab terminals 41 to 48 are automatically guided to and inserted into the forked inserting portions 11*b* to 18*b* of the connection terminals 11 to 18, thereby easily establishing an electrical connection between the connection terminals 11 to 18 and the tab terminals 41 to 48. Further, the insertion holes 51 to 58 make it possible for the tab terminals 41 to 48 not to project out from the outermost casing portion 40A. Furthermore, since the suspended pieces 61 to 66 which are integral parts of the outermost casing portion 40A generally made of an insulating material are present between adjacent tab terminals 41 to 48 to thereby insulate the adjacent tab terminals 41 to 48 from each other, a short circuit between the adjacent tab terminals 41 to 48 can be prevented.

Further, in the first embodiment, even though the fuse main bodies 1 to 6 and the connection terminals 11 to 18 are separate members and intersect with each other, the connecting portions 11*a* to 18*a* with which the fuse terminals 1*b* to 6*b*, 1*c* to 6*c* are to be connected are parallel with the fuse terminals 1*b* to 6*b*, 1*c* to 6*c*. Thus, connection by welding is easier. Furthermore, since the fuse terminals 1*b* to 3*b* connected with the three fusing elements 1*a* to 3*a* are connected with the common connecting portion 11*a* and the fuse terminals 4*b* to 6*b* connected with the three fusing elements 4*a* to 6*a* are connected with the common connecting portion 18*a* in the first embodiment, the number of the connection terminals can be reduced as compared to a case where the respective fuse terminals 1*b* to 3*b*, 4*b* to 6*b* are connected with separate connecting portions, which brings about an advantage of low production costs.

Although the three fuse main bodies 1 to 3, 4 to 6 are connected with the common connection portion 11*a*, 18*a* in the first embodiment, the present invention is not limited thereto. The present invention is also applicable to cases where two, four or more fuse main bodies are connected with the common connecting portion 11*a*, 18*a*. Further, the present invention is applicable not only to the construction provided with two common connecting portions 11*a*, 18*a*, but also to constructions provided with one, three or more common connecting portions.

In the case of changing the fusing characteristics, i.e., the fuse capacities of the respective fusing elements in the first embodiment, the fuse casing 10 and the connection terminals 11 to 18 can be commonly used, thereby advantageously improving mass productivity.

Although the connection terminals of the fuse device are connected with the tab terminals of the electrical connection box in the first embodiment, the present invention is not limited thereto. The present invention is also applicable to general connection casings for accommodating busbars having tab terminals at their ends similar to the electrical connection box.

Figure 7:
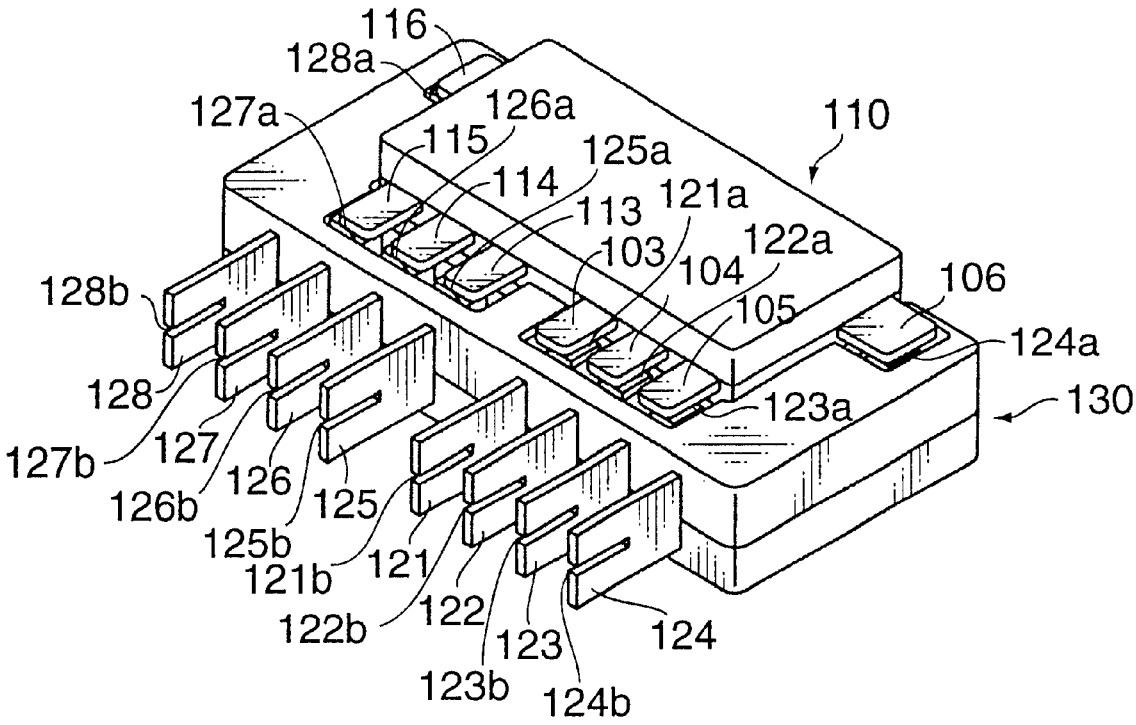
FIG. 7 is a perspective view showing an external configuration of a fuse device according to a second embodiment of the present invention.
Figure 8:
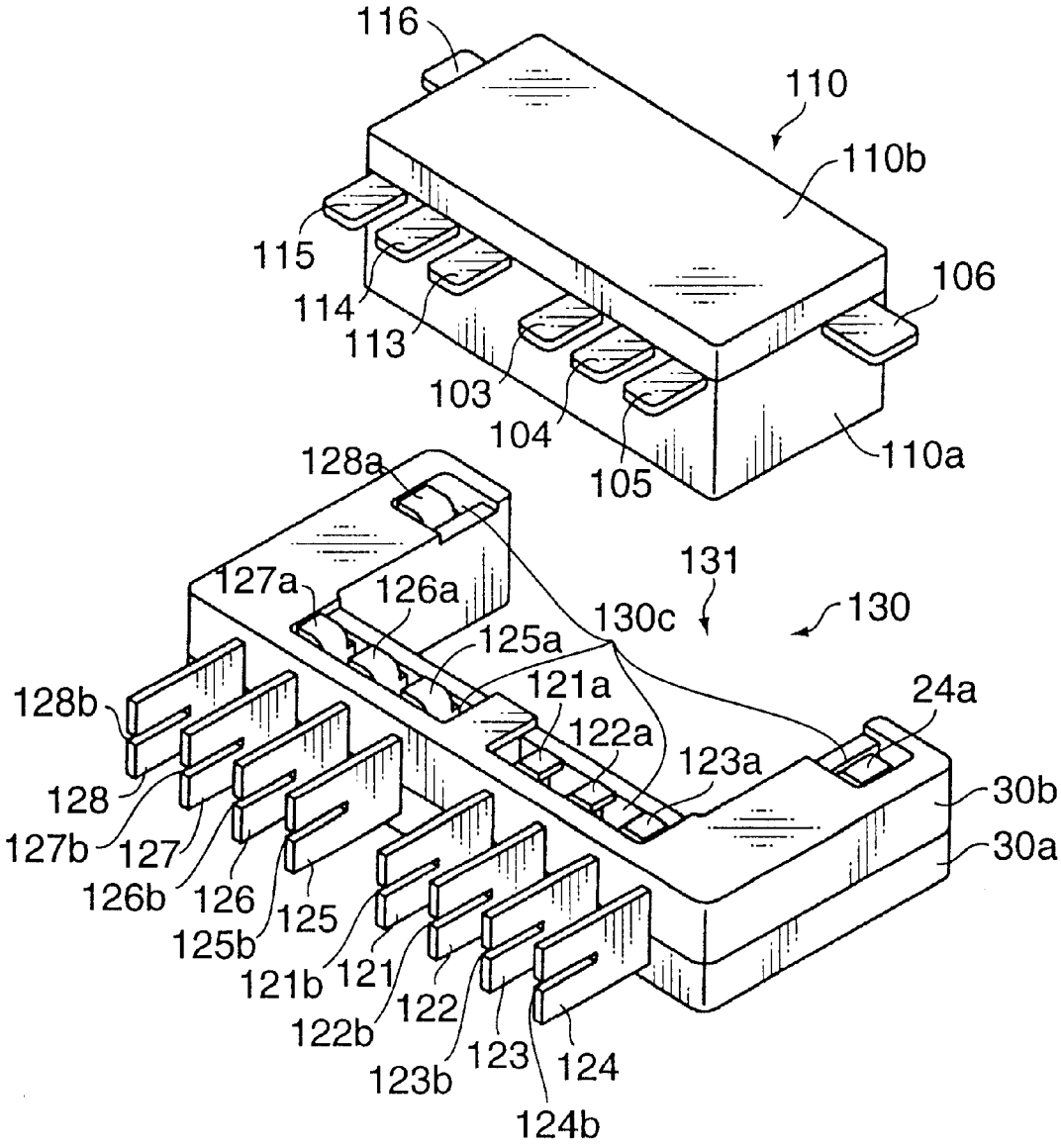
FIG. 8 is an exploded perspective view of the fuse device of FIG. 7 immediately before assembling.
Figure 9:
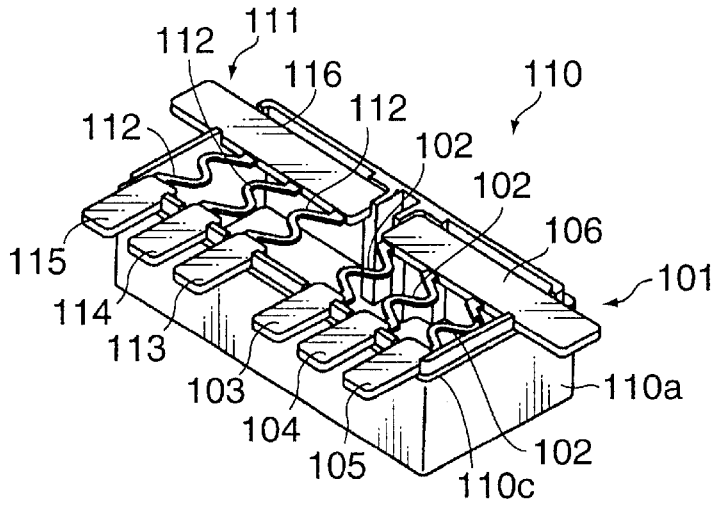
FIG. 9 is a perspective view showing an interior of a fuse casing forming the fuse device of FIG. 7.
Figure 10:
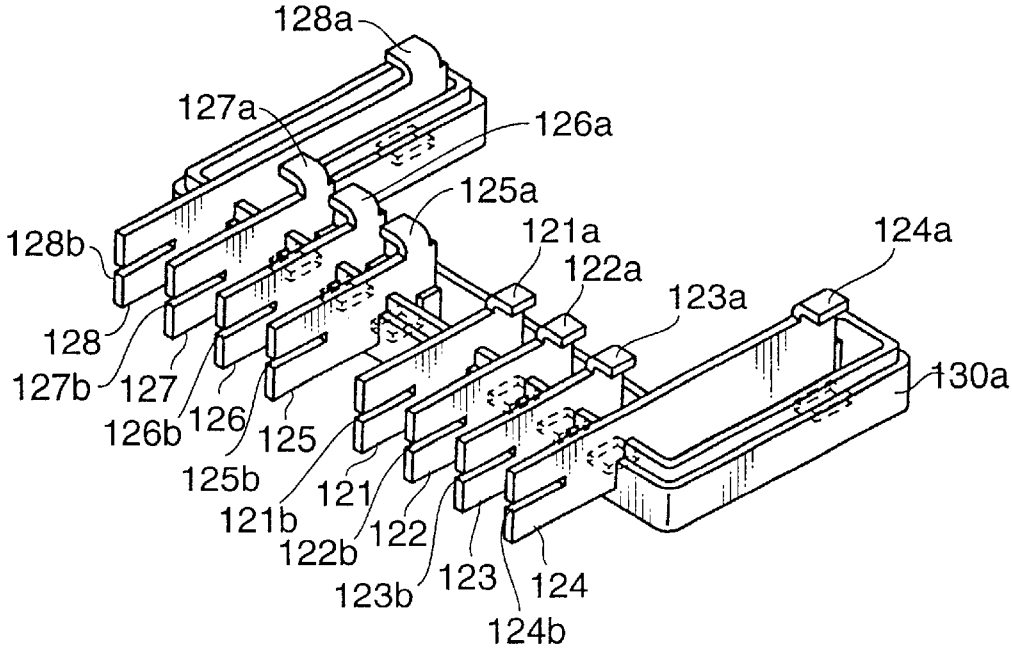
FIG. 10 is a perspective view showing an interior of a connection terminal casing forming the fuse device of FIG. 7.

FIG. 7 is a perspective view showing an external configuration of a fuse device according to a second embodiment, FIG. 8 is an exploded perspective view of the fuse device of FIG. 7 immediately before assembling, FIG. 9 is a perspective view showing an interior of a fuse casing, and FIG. 10 is a perspective view showing an interior of a connection terminal casing.

This fuse device includes a fuse casing 110 and a connection terminal casing 130 as shown in FIG. 8.

The fuse casing 110 is comprised of a fuse casing main body 110*a* and a cover 110*b*. As shown in FIG. 9 (cover 110*b* is not shown), two plate-shaped fuse main bodies 101, 111 are accommodated in the fuse casing 110 except portions thereof. The fuse main body 101 is made of a low-melting material such as Zn and is an integral piece comprised of a plurality of (three in the shown example) fusing elements 102, fuse terminals (output terminals) 103, 104, 105 separately connected with ends of the three fusing elements 102 and a fuse terminal (input terminal) 106 connected with the other ends of the three fusing elements 102. The fuse main body 111 is also made of the same material and has the same construction as the fuse main body 101. Specifically, the fuse main body 111 is an integral piece comprised of a plurality of (three in the shown example) fusing elements 112, fuse terminals (output terminals) 113, 114, 115 separately connected with ends of the three fusing elements 112 and a fuse terminal (input terminal) 116 connected with the other ends of the three fusing elements 112.

The fuse main bodies 101, 111 are formed by, after being stamped out from a plate material, thinning the fusing elements 102, 112 by carving. It should be noted that the fuse main bodies 101, 111 are identical members mounted like mirror images.

The fuse main bodies 101, 111 are mounted in the fuse casing 110 such that the respective fuse terminals 103 to 106, 113 to 116 of the fuse main bodies 101, 111 project out from the fuse casing 110 while being located on the same plane, i.e., while being arranged along an opening edge 110*c* of the fuse casing 110*a*.

On the other hand, the connection terminal casing 130 is U-shaped so as to have a hollow portion 131 into which the fuse casing 110 is fitted, and is comprised of lower and upper half pieces 130*a*, 130*b* placed one over the other in FIG. 8.

As shown in FIG. 10, eight connection terminals 121, 122, 123, 124, 125, 126, 127, 128 are accommodated in the connection terminal casing 130 except portions thereof. These connection terminals 121 to 128 are made of Cu or like electrically conductive metal having a larger strength than the fuse main bodies 101, 111.

The connection terminals 121, 122, 123 have the same construction, and connecting portions 121*a*, 122*a*, 123*a* to be connected with the fuse terminals 103, 104, 105 are formed at the base ends by bending portions of the respective connection terminals 121, 122, 123 in such a manner as to be parallel with the fuse terminals 103, 104, 105, whereas forked inserting portions 121*b*, 122*b*, 123*b* each having a specified slit are formed at the leading ends of the connection terminals 121 to 123.

The connection terminal 124 is longer than the connection terminals 121 to 123, and a connecting portion 124*a* to be connected with the fuse terminal 106 is formed at the base end by bending a portion of the connection terminal 124 in such a manner as to be parallel with the fuse terminal 106, whereas a forked inserting portion 124*b* having a specified slit is formed at the leading end.

The connection terminals 125, 126, 127 have the same construction, and connecting portions 125*a*, 126*a*, 127*a* to be connected with the fuse terminals 113, 114, 115 are formed at the base ends by bending portions of the respective connection terminals 125, 126, 127 in a direction opposite from the connecting portions 121*a* to 123*a* in such a manner as to be parallel with the fuse terminals 113, 114, 115, whereas forked inserting portions 125*b*, 126*b*, 127*b* each having a specified slit are formed at the leading ends of the connection terminals 125 to 127.

The connection terminal 128 is longer than the connection terminals 125 to 127, and a connecting portion 128*a* to be connected with the fuse terminal 116 is formed at the base end by bending a portion of the connection terminal 128 in a direction opposite from the connecting portion 124*a* in such a manner as to be parallel with the fuse terminal 116, whereas a forked inserting portion 128*b* having a specified slit is formed at the leading end. It should be noted that the connection terminals 121 to 128 intersect with, e.g., are normal to the fuse terminals 103 to 106, 113 to 116 except the connecting portions 121*a* to 128*a*.

These eight connection terminals 121 to 128 are, as shown in FIG. 8, accommodated in the connection terminal casing 130 such that the respective connecting portions 121*a* to 128*a* are exposed through openings 130*c* formed at the periphery of the hollow portion 131 of the upper half piece 130*b* and the forked inserting portions 121*b* to 128*b* project out from a side opposite from the hollow portion 131.

When the fuse casing 110 is fitted into the hollow portion 131 of such a connection terminal casing 130 from the exposed sides of the connecting portions 121*a* to 128*a*, i.e., from the state of FIG. 8 to the state of FIG. 7, the respective fuse terminals 103 to 106, 113 to 116 are brought into contact with the corresponding connecting portions 121*a* to 128*a*. The casings 110, 130 are made integral to each other by coupling these contact portions by, e.g., welding, thereby completing the fuse device.

Figure 11:
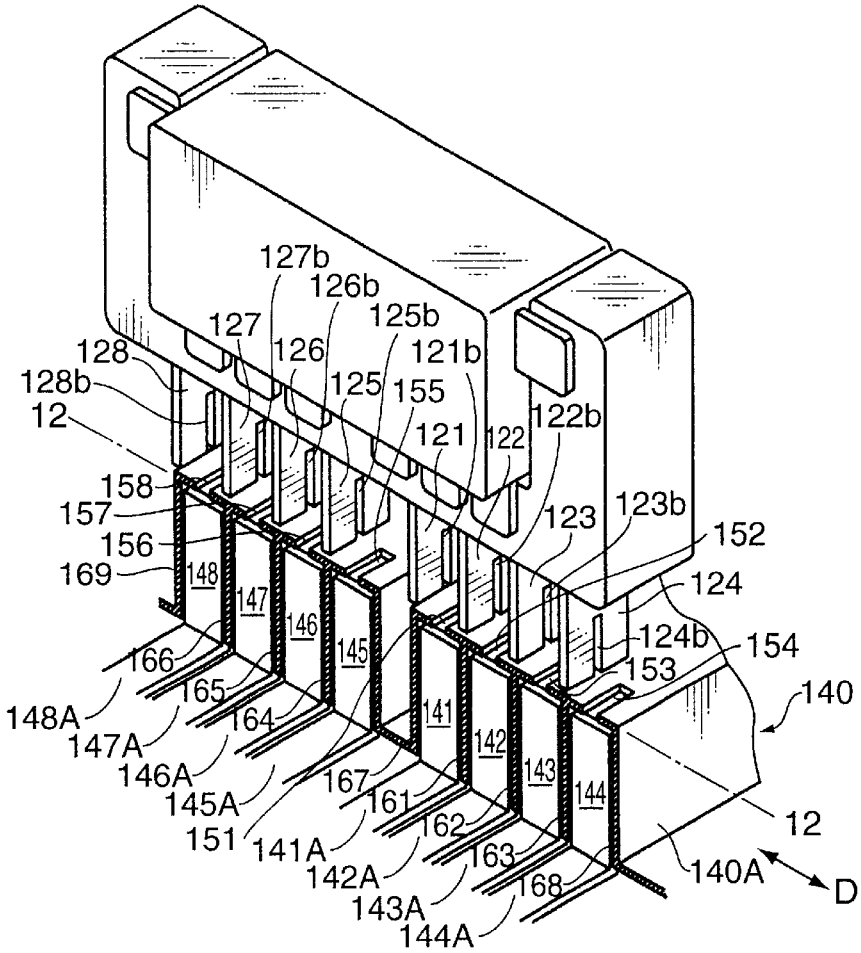
FIG. 11 is a perspective view showing how the fuse device of FIG. 7 is connected with tab terminals.

FIG. 11 is a perspective view showing the construction of a mating electrical connection box 140 with which the fuse device is to be connected. In FIG. 11, a casing portion 140A of the electrical connection box 140 is shown in section along 12—12.

Busbars 141A to 148A having tab terminals 141 to 148 at their ends are accommodated in this electrical connection box 140, and the upper ends of the tab terminals 141 to 148 reach up to the vicinity of the inner surface of the outermost casing portion 140A of the electrical connection box 140. The thickness of the tab terminals 141 to 148 is substantially equal to the width of the slits of the forked inserting portions 121*b* to 128*b*.

The outermost casing portion 140A is made of, e.g., an insulating resin, and slit-shaped insertion holes 151 to 158 into which the connection terminals 121 to 128 of the fuse device are insertable are so formed in a portion of the casing portion 140A covering the tab terminals 141 to 148 as to extend in a direction normal to widthwise directions D of the tab terminals 141 to 148. At the longitudinal center positions of the respective insertion holes 151 to 158, the centers of the respective tab terminals 141 to 148 with respect to widthwise directions D are exposed.

The length of the insertion holes 151 to 158 are substantially equal to the width of the connection terminals 121 to 128, whereas the width thereof is substantially equal to the thickness of the connection terminals 121 to 128. Suspended pieces 161 to 163 which are integral parts of the outermost casing portion 140A are provided between four adjacent tab terminals 141 to 144, whereas suspended pieces 164 to 166 which are integral parts of the outermost casing portion 140A are provided between four adjacent tab terminals 145 to 148. Further, bent portions 167, 168, 169 of the outermost casing portion 140A are provided between the tab terminals 144 and 145 and at the outer sides of the tab terminals 141 and 148, respectively.

Figure 12:
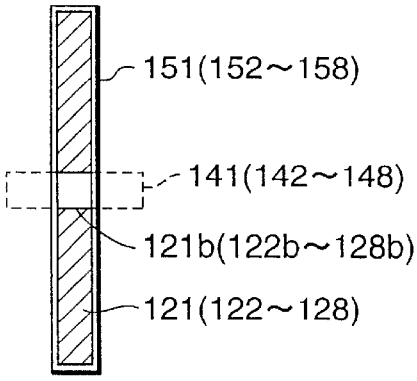
FIG. 12 is a plan view in section showing a state where connection terminals of the fuse device of FIG. 7 are connected with the tab terminals of an electrical connection box.

The fuse device is connected with the electrical connection box 140 thus constructed as follows. By inserting the connection terminals 121 to 128 of the fuse device into the insertion holes 151 to 158, the connection terminals 121 to 128 are guided by the insertion holes 151 to 58 so that the tab terminals 141 to 148 are inserted into the forked inserting portions 121*b* to 128*b* of the connection terminals 121 to 128 as shown in FIG. 12, thereby electrically connecting the connection terminals 121 to 128 and the tab terminals 141 to 148.

As described above, since the connection terminals 121 to 128 include the forked inserting portions 121*b* to 128*b* into which the tab terminals 141 to 148 are inserted for connection in the second embodiment, the connection terminals 121 to 128 and the tab terminals 141 to 148 can be directly connected, thereby improving a connection operability. At this time, since the connection terminals 121 to 128 are connected with the corresponding tab terminals 141 to 148 such that the widthwise direction thereof intersects with (is normal to) that of the tab terminals 141 to 148, the tab terminals 141 to 148 can be easily inserted into the forked inserting portions 121 to 128. Further, since the connection terminals 121 to 128 and the fuse main bodies 101, 111 having the fusing elements 102, 112 are separate members, materials suited to the purposes can be used for the fusing elements 102, 112 aimed to be fused and the connection terminals 121 to 128 aimed to be connected with the tab terminals 141 to 148. Specifically, the connection terminals 121 to 128 and the tab terminals 141 to 148 can be held satisfactorily connected over a long time by using a material such as Zn having a desired fusing characteristic for the fusing elements 102, 112 while using a material such as Cu having a high strength for the connection terminals 121 to 128. Further, since the connection terminals 121 to 128 and the fuse main bodies 101, 111 having the fusing elements 102, 112 are made firmly integral to each other by welding, the fuse device can be easily handled and can have a better connectability with the tab terminals 141 to 148.

Further, according to the fuse device connecting structure of the second embodiment, when the connection terminals 121 to 128 of the fuse device are inserted into the insertion holes 151 to 158, the tab terminals 141 to 148 are automatically inserted into the forked inserting portions 121*b* to 128*b* of the connection terminals 121 to 128, thereby easily establishing an electrical connection between the connection terminals 121 to 128 and the tab terminals 141 to 148. Further, since the width of the slits of the forked inserting devices 121*b* to 128*b* is substantially equal to the thickness of the tab terminals 141 to 148, the connection terminals 121 to 128 and the tab terminals 141 to 148 can be securely connected. Furthermore, since the tab terminals 141 to 148 are accommodated inside the outermost casing portion 140A, it can prevent the tab terminals 141 to 148 from projecting out of the outermost casing portion 140A. Further, since the suspended pieces 161 to 166 which are integral parts of the outermost casing portion 140A made of the insulating material are present between adjacent tab terminals 141 to 148 to thereby insulate the adjacent tab terminals 141 to 148 from each other, a short circuit between adjacent tab terminals 141 to 148 can be prevented.

Further, in the second embodiment, even though the fuse main bodies 101, 111 and the connection terminals 121 to 128 are separate members and the fuse terminals 103 to 106, 113 to 116 of the fuse main bodies 101, 111 and the connection terminals 121 to 128 intersect with each other, the connecting portions 121*a* to 128*a* with which the fuse terminals 103 to 106, 113 to 116 are to be connected are parallel with the fuse terminals 103 to 106, 113 to 116. Thus, connection by welding is easier. Furthermore, since three fusing elements 102, 112 are connected with the common fuse terminal 106, 116 in the second embodiment, the number of the fuse terminals can be reduced as compared to a case where the respective fusing elements are connected with separate fuse terminals, which brings about an advantage of low production costs. Further, in the second embodiment, the respective fuse terminals 103 to 106, 113 to 116 are brought into contact with the respective connecting portions 121*a* to 128*a* when the fuse casing 110 is fitted into the hollow portion 131 of the connection terminal casing 130 from the exposed side of the connecting portions 121*a* to 128*a*. This brings about an advantage of fairly easy assembling.

Although each fuse main body is provided with three fusing elements in the second embodiment, the present invention is not limited thereto. The present invention is similarly applicable even if each fuse main body is provided with one, two, four or more fusing elements.

In the case of changing the fusing characteristics, i.e., the fuse capacities of the respective fusing elements in the second embodiment, the connection terminal casing 130 can be commonly used only by changing the fuse casing 110, thereby advantageously improving mass productivity.

Although the connection terminals of the fuse device are connected with the tab terminals of the electrical connection box in the second embodiment, the present invention is not limited thereto. The present invention is similarly applicable to general connection casings for accommodating busbars having tab terminals at their ends like the electrical connection box.

As described in detail above, an inventive fuse device, comprising a fuse main body in which the opposite ends of a fusing element are connected with fuse terminals, a plurality of connection terminals which are members separate from the fuse main body. A fuse circuit in which the fusing element is provided between the connection terminals is formed by directly connecting the fuse terminals of the fuse main body with the connection terminals.

Since the fuse main body to be directly connected with the connection terminals are formed separately from the connection terminals, the fusing characteristic of the fusing element and the strength of the connection terminals can be adjusted without influencing each other. In the inventive fuse device, the fuse main body may be such that the fuse terminals are formed at the opposite ends of the fusing element and a plurality of such fuse main bodies may be provided.

With this construction, a plurality of kinds of fuse main bodies having the fusing elements of different thicknesses can be prepared beforehand in large quantities, and a desired one whose fusing element has a thickness in conformity with a specified fusing characteristic can be selected from the plurality of kinds of fuse main bodies thus prepared and connected with the connection terminal.

Figure 13:
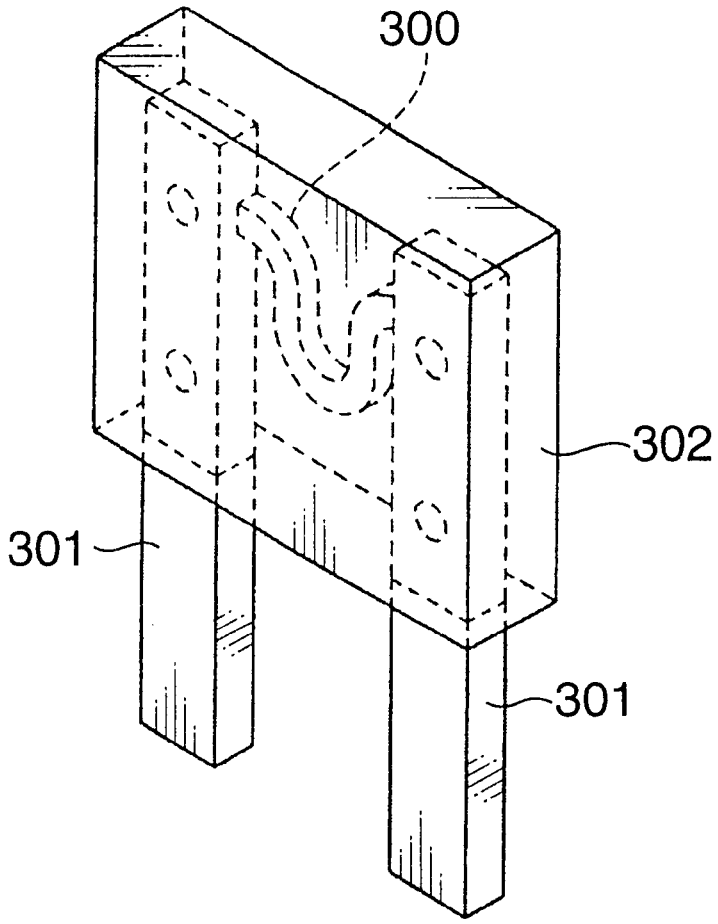
FIG.13 PRIOR ART
FIG. 13 is a perspective view showing an external configuration of an exemplary conventional fuse device.
Figure 14:
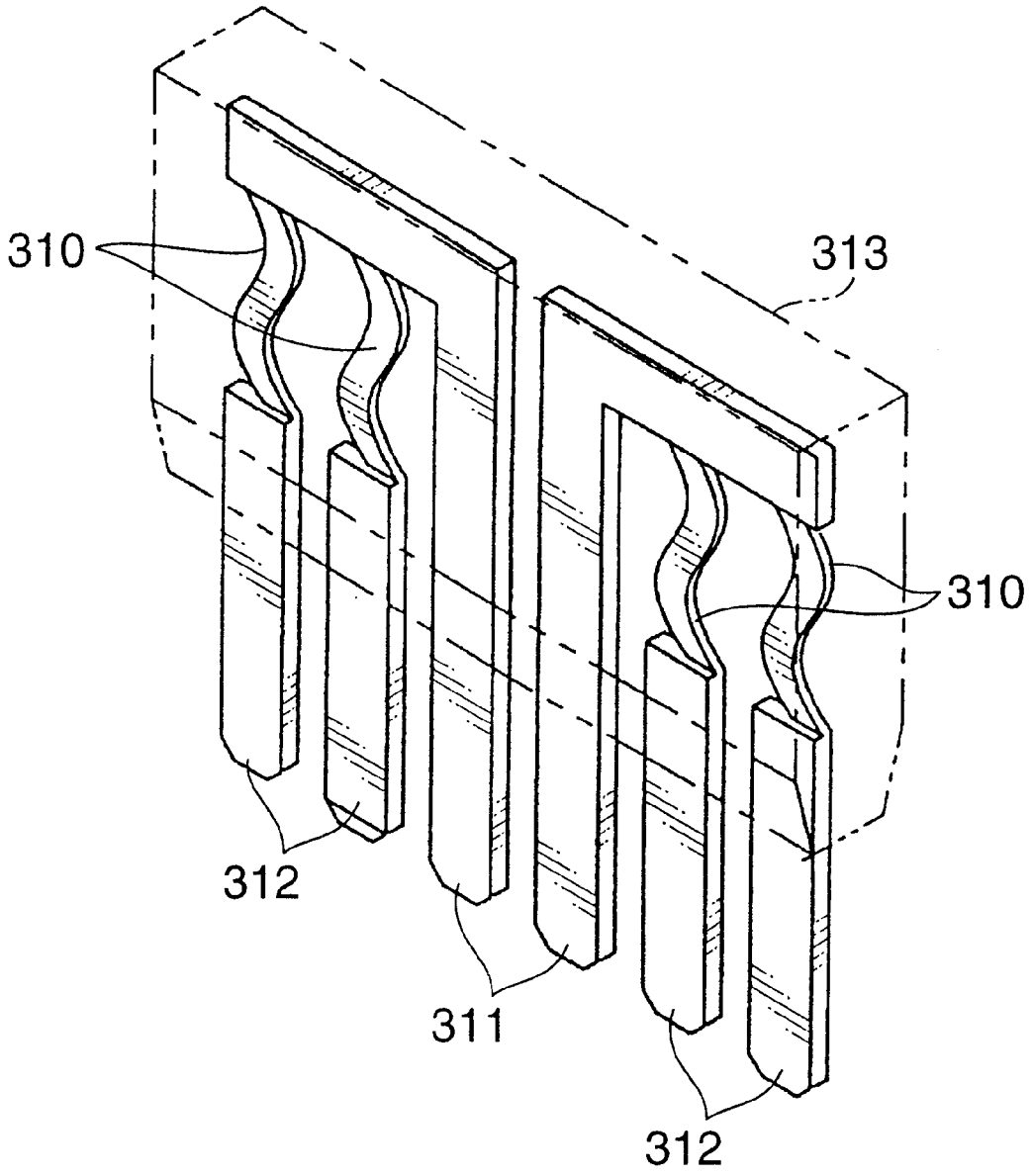
PRIOR ART FIG.14
FIG. 14 is a perspective view showing an external configuration of another exemplary conventional fuse device.
Figure 15:
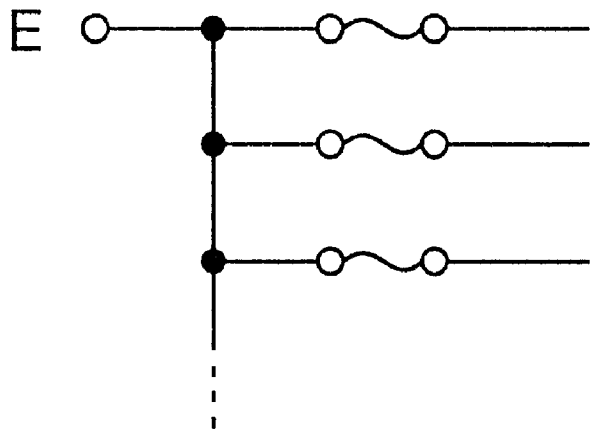
FIG. 15 is an equivalent circuit diagram of a fuse circuit in which a plurality of fuses are connected with one battery output terminal.

In constructing a fuse circuit in which a plurality of fuses are connected with one battery output terminal (E), for example, as shown in FIG. 15, if the fuse device of FIG. 13 is used, the same number of fuse devices as the fuses are necessary and a busbar board becomes complicated in construction since this fuse device has only one fusing element. On the other hand, since the fuse device of FIG. 14 has two fusing elements, the number of the fuse devices can be reduced and a busbar board which is a mount object of the fuse devices can be advantageously simpler in construction.

In the case that the fusing characteristics (fuse capacities) of the respective fuse portions (fusing elements) are desired to be changed, for example, when the fuse circuit shown in FIG. 15 is constructed by the fuse devices of FIG. 14, technique of changing the lengths and widths of the respective fusing elements is adopted. However, such a technique has a limit in differing the fuse capacities. A most effective technique in differing the fuse capacities may be to change the thicknesses of the respective fusing elements. However, since the metal pieces of the fuse device of FIG. 14 are stamped out from the single metallic plate, it is necessary to apply processing, e.g., carving to the outer surfaces of the individual fusing elements 310 after stamping in order to change the thicknesses of the fusing elements 310. This results in a poor productivity. Thus, in the case of constructing the fuse circuit including a plurality of fuses having different capacities, it is an only way in view of mass productivity to use a plurality of kinds of fuse devices of the type having only a single fusing element as shown in FIG. 13 in combination, obliging the busbar board to become complicated in construction.

Contrary to this, according to the present invention, the fuse main bodies whose fusing elements have thicknesses in conformity with desired fusing characteristics can be selected and connected with the connection terminals. Therefore, a fuse circuit including a plurality of fusing elements having different fusing characteristics can be constructed as a single unit. Further, the respective kinds of fuse main bodies can be mass-produced by stamping out, for example, a metallic plate having a thickness substantially equal to that of the fusing elements of the fuse main bodies. Productivity can be remarkably improved as compared to, for example, a case where the respective fusing elements of the conductors made of a single metallic plate as shown in FIG. 14 are individually carved to adjust their thicknesses. Further, since the single unit includes a plurality of fuse main bodies, the number of the fuse devices to be mounted on a mount object such as a busbar board can be reduced without complicating the construction of the mount object.

Preferably, the fusing elements of at least two fuse main bodies have different thicknesses. With this construction, it can be realized to construct the fuse circuit including a plurality of fusing elements having different fusing characteristics as a single unit.

Preferably, the fuse terminals of each of the plurality of fuse main bodies are spaced apart by the same distance. With this construction, the fuse main bodies having different fusing characteristics can be replaced by each other, and the connection terminals can be commonly used.

Preferably, the connection terminals are provided with forked inserting portions, and tab terminals of a busbar board are inserted into the forked inserting portions, thereby electrically connecting the tab terminals with the connection terminals.

Figure 16:
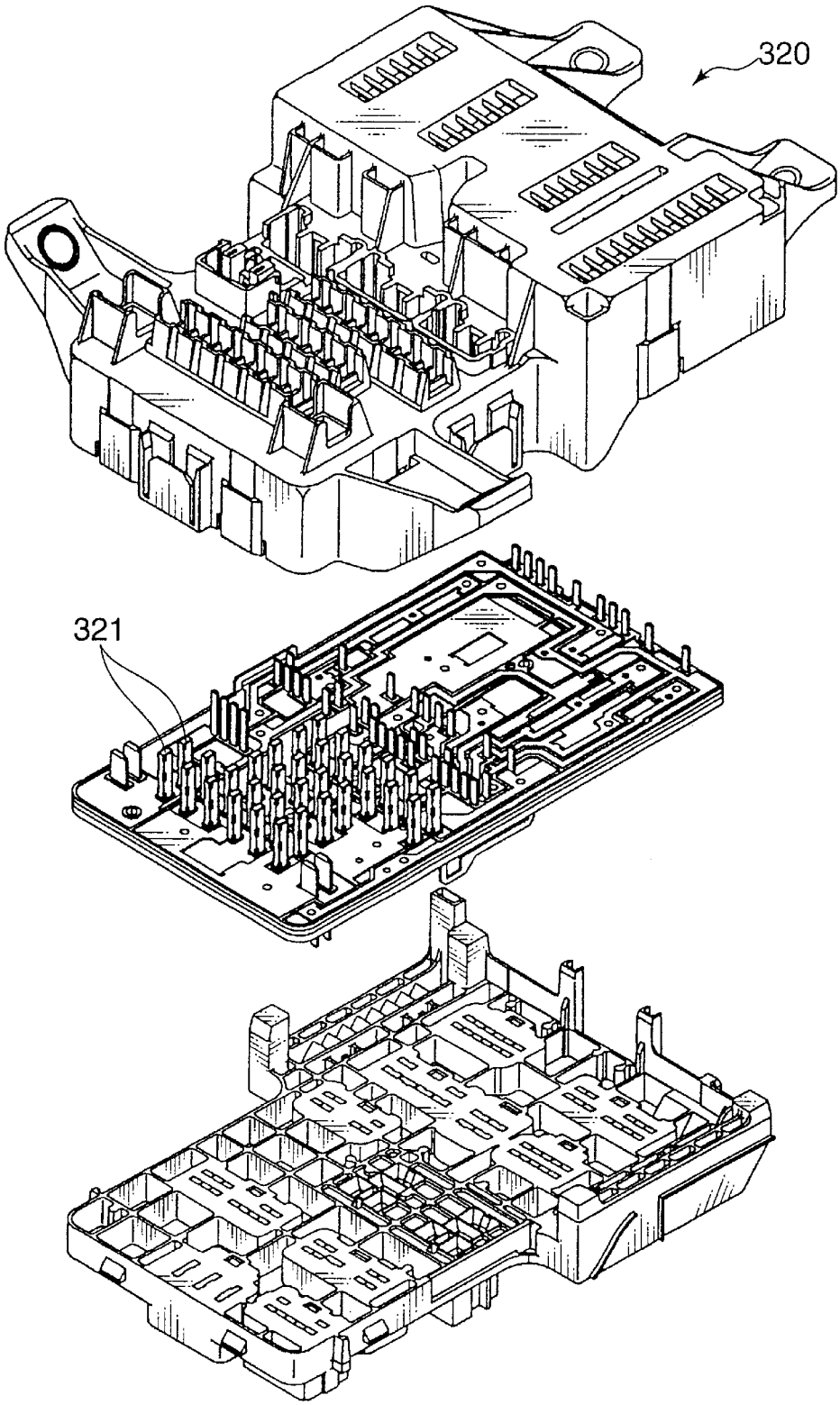
PRIOR ART FIG.16
FIG. 16 is an exploded perspective view showing the construction of an electrical connection box in which the conventional fuses are mounted.

With this construction, the fuse device can be directly connected with the tab terminals without using intermediate terminals. More specifically, the connection terminals 301 shown in FIG. 13 and the connection terminals 311, 312 shown in FIG. 14 are male terminals in the conventional fuse devices. If the tab terminals to be connected with these connection terminals 301, 311, 312 are also male terminals, intermediate terminals 321 having female terminals at their opposite ends as shown in FIG. 16 need to be used (identified by 320 in FIG. 16 is an electrical connection box). However, in the case of this connecting structure, it is not necessary to use intermediate terminals even if the tab terminals are male terminals since the connection terminals of the fuse device have the forked inserting portions.

Preferably, the connection terminals and the fuse terminals of the fuse main body which are separate members are connected by welding. Then, the connection terminals and the fuse main body can be made firmly integral to each other, thereby making it easier to handle the fuse device and bettering a connectability with the tab terminals.

Preferably, the connection terminals are made of a material having a higher strength than the fuse main body. Then, the connection terminals and the tab terminals can be held satisfactorily connected over a long time by using a material having a desired fusing characteristic for the fuse main body while using a material having a high strength for the connection terminals.

Preferably, the connection terminals are arranged such that the widthwise direction thereof intersects with that of the tab terminals. Then, the tab terminals can be easily inserted into the forked inserting portions of the connection terminals.

An inventive fuse device connecting structure, comprises a fuse device according to the first aspect of the present invention, and tab terminals formed at ends of a busbar. The width of a slit of a forked inserting portion provided at each connection terminal of the fuse device is substantially equal to the thickness of the tab terminals.

With this connecting structure, since the connection terminals and the tab terminals can be connected with each other by directly inserting the tab terminals into the forked inserting portions of the respective connection terminals, it is not necessary to use intermediate terminals and a connecting operability can be improved. In addition, since the width of the slits of the forked inserting portions is substantially equal to the thickness of the tab terminals to be inserted into the slits of the forked inserting portions, the connection terminals and the tab terminals can be securely connected.

Preferably, the fuse device connecting structure further comprises a connection casing for accommodating the tab terminals, and insertion holes into which the connection terminals of the fuse device are insertable are so formed in a portion of the connection casing covering the tab terminals as to extend in a direction normal to the widthwise direction of the tab terminals.

With this construction, the tab terminals are automatically inserted into the forked inserting portions of the connection terminals when the connection terminals of the fuse device are inserted into the insertion holes, thereby easily establishing an electrical connection between the tab terminals and the connection terminals. Further, the tab terminals can be prevented from projecting out of the casing.

Preferably, part of the connection casing is present between adjacent tab terminals to insulate the adjacent tab terminals from each other. With this construction, since the part of the connection casing generally made of an insulating material is present between adjacent tab terminals to insulate them from each other, a short circuit between the adjacent tab terminals can be prevented.

This application is based on patent application Nos. 2000-364604 and 2000-371771 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fuse device comprising:

a plurality of connection terminals that each lead outside the fuse device;

a plurality of fuse elements which are to melt in response to over-current passing therethrough; and a plurality of pairs of fuse terminals, each pair of fuse terminals being provided on opposite sides of a respective one of the fuse elements, each fuse terminal being fixedly and directly connected with one of the connection terminals, wherein the connection terminals include at least one output connection terminal, one of each pair of the fuse terminals being fixedly connected with one of the at least one output connection terminal, and a plurality of input connection terminals respectively connected with the other of each pair of the fuse terminals.

2. The fuse device according to claim 1, wherein the fuse elements and fuse terminals are integrally made of a same material.

3. The fuse device according to claim 2, wherein a plurality of groups of the fuse elements and the fuse terminals are provided, and the at least one output connection terminal comprises a plurality of output connection terminals, with one of each pair of the fuse terminals of a same group being connected with one of the output connection terminals and the other of each pair of fuse terminals being connected with a respective one of the input connection terminals.

4. The fuse device according to claim 2, wherein at least two of the fuse elements have different melting characteristics from each other.

5. A fuse device comprising:

a plurality of connection terminals;

a plurality of fuse elements which are to melt in response to over-current passing therethrough;

a plurality of fuse terminals respectively provided at first ends of the fuse elements, the fuse terminals being fixedly connected with the connection terminals, and a common fuse terminal connected with second ends of the fuse elements, the common fuse terminal being connected with a connection terminal which is different from the connection terminals connected with the fuse terminals provided on the first ends of the fuse elements.

6. A fuse device comprising:

a plurality of connection terminals;

a plurality of fuse elements which are to melt in response to over-current passing therethrough; and fuse terminals provided on opposite sides of each fuse element, the fuse terminals being fixedly connected with the connection terminals, and at least two of the fuse elements having different melting characteristics from each other, wherein each of the connection terminals respectively connected with the fuse terminals on one side of the fuse elements has a bifurcated inserting portion with a plate shape including bifurcated branches separated by a slit, the slit being adapted to receive a plate-shaped tab terminal of a busbar for electric connection of the connection terminal with the tab terminal.

7. A fuse device according to claim 6, wherein the fuse terminals and fuse elements are integrally made of material having a desired fusing characteristic and the connection terminals are made of material different from and having higher strength than that of the fuse terminals and fuse elements.

8. A fuse device according to claim 6, wherein the bifurcated inserting portions are arranged to be coupled with corresponding ones of the tab terminals in a manner that each plate-shaped inserting portion and tab terminal intersect with each other with planes of their plate shapes being normal to each other.

9. A fuse device connecting structure comprising:

a fuse device including a plurality of connection terminals and a plurality of fuse bodies, each fuse body having a fuse element which is to melt in response to over-current, and fuse terminals provided on opposite sides of the fuse element, the fuse terminals being fixedly connected with the connection terminals, each of the connection terminals connected with the fuse terminals on one side of the fuse elements, respectively has a bifurcated inserting portion including bifurcated branches separated by a slit; and a plurality of busbars each of which has a tab terminal formed at one end of the busbar, the tab terminal being coupled with a corresponding one of the bifurcated inserting portions of the connection terminals.

10. A fuse device connecting structure according to claim 9, wherein the inserting portions and tab terminals each have a plate shape and are coupled with each other in a manner that planes of the inserting portions and tab terminals are normal to each other and the tab terminals fit into the slits of the inserting portions.

11. A fuse device connecting structure according to claim 10, wherein the slit of each of bifurcated inserting portions has a width substantially equal to a thickness of the tab terminal to accept the tab terminal.

12. A fuse device connecting structure, comprising:

a fuse device comprising connection terminals, and a fuse main body including fuse terminals and a fusing element whose opposite ends are connected with the fuse terminals, wherein the fuse terminals are directly connected with the respective connection terminals to form a fuse circuit in which the fusing element is between the connection terminals;

tab terminals formed at ends of a busbar; and a connection casing for accommodating the tab terminals;

wherein the connection terminals are provided with forked inserting portions, and the tab terminals of the busbar are inserted into the forked inserting portions, thereby electrically connecting the tab terminals with the connection terminals;

wherein a width of a slit of a forked inserting portions is substantially equal to the thickness of the tab terminals; and wherein insertion holes into which the connection terminals of the fuse device are insertable are so formed in a portion of the connection casing covering the tab terminals as to extend in a direction normal to the widthwise direction of the tab terminals.

13. The fuse device connecting structure according to claim 12, wherein part of the connection casing is present between adjacent tab terminals to insulate the adjacent tab terminals from each other.

* * * * *